US008439010B2

(12) United States Patent
Fernandez

(10) Patent No.: US 8,439,010 B2
(45) Date of Patent: May 14, 2013

(54) INTERNAL COMBUSTION ENGINE

(76) Inventor: Edwin M. Fernandez, Phillips Ranch, CA (US)

( * ) Notice: Subject to any disclaimer, the term of this patent is extended or adjusted under 35 U.S.C. 154(b) by 286 days.

(21) Appl. No.: 12/938,966

(22) Filed: Nov. 3, 2010

(65) Prior Publication Data

US 2012/0103300 A1 May 3, 2012

(51) Int. Cl.
*F02B 75/32* (2006.01)

(52) U.S. Cl.
USPC ..... 123/197.4; 123/46 R

(58) Field of Classification Search ..... 123/197.4, 123/197.1, 197.2, 193.4, 193.3, 46 R, 46 SC, 123/50 R
See application file for complete search history.

(56) References Cited

U.S. PATENT DOCUMENTS 3,084,678 A * 4/1963 Lindsay ..... 123/51 BA
4,462,345 A * 7/1984 Routery ..... 123/57.1
4,856,463 A 8/1989 Johnston
5,257,601 A 11/1993 Coffin
5,483,929 A 1/1996 Kuhn et al.
7,234,423 B2 * 6/2007 Lindsay ..... 123/42
2003/0111028 A1 6/2003 Hallenstvedt

* cited by examiner

*Primary Examiner* — Noah Kamen
*Assistant Examiner* — Long T Tran
(74) *Attorney, Agent, or Firm* — Kelly & Kelley, LLP

(57) ABSTRACT

An engine includes an engine block comprising a cylinder, an intake and exhaust port, and two linearly opposing pistons reciprocatingly mounted relative to two opposing crankshafts. A pair of piston sleeves are reciprocatingly mounted in the cylinder around each piston and connected relative to their respective crankshafts. Each piston sleeve includes a slotted port in communication with either the intake or exhaust port. A pair of sleeve couplers are pivotably connected to their respective piston sleeves and eccentrically rotatable relative to their respective crankshafts. A pair of eccentric inserts include an outside circumferential surface concentrically offset from an inside circumferential surface aperture. Each inside circumferential surface aperture is pivotable about its respective crankshaft. Each outside circumferential surface is rotatable relative to its respective sleeve coupler. A pair of phase couplers are helically moveable about their respective crankshafts and are also pivotably fixed and slidable relative to their respective eccentric inserts.

37 Claims, 14 Drawing Sheets

INTERNAL COMBUSTION ENGINE

FIELD OF THE INVENTION

The present invention generally relates to internal combustion engines. More particularly, the present invention relates to an improved two-cycle engine with opposed pistons located in a common cylinder with reciprocating ported piston sleeves.

BACKGROUND OF THE INVENTION

U.S. Pat. No. 3,084,678 discloses an internal combustion engine of the type described above having opposed pistons and reciprocating sleeves to alter the porting characteristics of the engine. The disclosure of the '678 patent is incorporated herein in its entirety by this reference. The engine of the '678 patent comprises opposed pistons having reciprocating sleeves around each piston, wherein related pistons and sleeves are connected to the same crankshaft. This resulted in a configuration that does not permit for adjustment of the timing of the sleeves with respect to the pistons to maximize efficiency and power. Thus, once an engine is constructed pursuant to the '678 patent, the timing of the movement of the reciprocating sleeves is fixed with respect to the movement of the related pistons.

U.S. Pat. No. 7,234,423 discloses an improved internal combustion engine of the type described above now having reciprocating sleeves connected to a shaft separate and distinct from the crankshaft. The disclosure of the '423 patent is also incorporated herein in its entirety by this reference. The engine of the '423 patent could advance or retard the timing of the motion of the reciprocating sleeve shaft with respect to the motion of the piston crankshaft through the additional shaft. However, the '423 patent did not teach how to advance or retard the timing without the use of an additional shaft. Furthermore, it was still not possible in the '423 to increase or decrease the amount of overlap between the intake/exhaust ports and the ported slots in the reciprocating sleeve shaft.

Accordingly, there is a need for a similar engine design that allows the timing between the pistons and the piston sleeves to be adjusted without the use of a secondary shaft. Furthermore, there is a need for a similar engine design that allows for the amount of overlap to be controlled between the intake/exhaust ports and the ported slots in the reciprocating sleeve shaft. The present invention fulfills these needs and provides other related advantages.

SUMMARY OF THE INVENTION

An exemplary embodiment of the internal combustion engine of the present invention includes an engine block comprising a cylinder including an intake port, and an exhaust port. Two linearly opposing pistons are reciprocatingly mounted relative to two opposing crankshafts. A pair of piston sleeves are reciprocatingly mounted in the cylinder around each piston and connected relative to their respective crankshafts. Each piston sleeve includes a slotted port in communication with either the intake port or the exhaust port.

A pair of sleeve couplers are pivotably connected to their respective piston sleeves and eccentrically rotatable relative to their respective crankshafts. A pair of eccentric inserts each have an outside circumferential surface concentrically offset from an inside circumferential surface aperture. Each inside circumferential surface aperture is pivotable about its respective crankshaft. Each outside circumferential surface is rotatable relative to its respective sleeve coupler.

A pair of phase couplers are helically moveable about their respective crankshafts. The phase couplers are also pivotably fixed and slidable relative to their respective eccentric inserts. Helical movement of the phase couplers about their respective crankshafts changes the relation of timing between the reciprocating pistons and the piston sleeves.

Each phase coupler moves in a helical motion due to a helical or liner slot and each crankshaft includes at least one protrusion disposed within each slot. Each protrusion is slidable relative to its respective slot. Each phase coupler can also comprise a fixed or rotatably attached disk disposed perpendicular to their respective crankshafts. A disk engagement can be associated with each disk and slidably fixed relative to the engine block. Each disk engagement is slidably controllable in a motion parallel to the crankshafts. Movement of each disk engagement controls the relation of timing between the reciprocating pistons and the piston sleeves. Furthermore, each eccentric insert and phase couplers includes at least one elongated tooth.

In another exemplary embodiment, an internal combustion engine includes an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts. A pair of piston sleeves are reciprocatingly mounted in the cylinder around each piston and mounted relative to their respective eccentric shafts. Each piston sleeve can have a slotted port in communication with either the intake port or the exhaust port.

A pair of sleeve couplers are pivotably connected to their respective piston sleeves and eccentrically rotatable relative to their respective eccentric shafts. A crankshaft gear is disposed at an end of each crankshaft and an eccentric shaft gear is disposed at an end of each eccentric shaft. A means for coupling the crankshaft gears and eccentric shaft gears can be a multitude of devices, such as chains, belts, or gears.

A pair of phase couplers are helically moveable about their respective eccentric shafts. The phase couplers are also pivotable fixed and slidable relative to their respective eccentric shaft gears. Helical movement of the phase couplers about their respective eccentric shafts changes the relation of timing between the reciprocating pistons and the piston sleeves.

Each phase coupler moves in a helical motion due to a helical or liner slot and each eccentric shaft includes at least one protrusion disposed within each slot. Each protrusion is slidable relative to its respective slot. Each phase coupler can include a fixed or rotatably attached disk disposed perpendicular to their respective eccentric shafts. A disk engagement can be associated with each disk and slidably fixed relative to the engine block. Each disk engagement is slidably controllable in a motion parallel to the crankshafts and eccentric shafts. The movement of each disk engagement controls the relation of timing between the reciprocating pistons and the piston sleeves. Furthermore, each eccentric shaft gear and phase couplers can include at least one elongated tooth. Furthermore, each sleeve coupler can further comprise a crankshaft aperture, wherein a corresponding crankshaft is positioned within the crankshaft aperture such that the eccentric shaft, crankshaft and cylinder are aligned within a common plane. It is possible in another exemplary embodiment where the eccentric shaft is not aligned in the common plane with the crankshaft and cylinder. Accordingly, the sleeve coupler and crankshaft aperture would be correspondingly modified to facilitate an offset eccentric shaft.

In yet another exemplary embodiment, an internal combustion engine includes an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts and moveable relative to the crankshafts. A pair of piston sleeves are reciprocatingly mounted in the cylinder around each piston and mounted relative to their respective eccentric shafts. Each piston sleeve can have a slotted port in communication with either the intake port or the exhaust port.

A pair of sleeve couplers are pivotably connected to their respective piston sleeves and eccentrically rotatable relative to their respective eccentric shafts. A crankshaft gear is disposed at an end of each crankshaft and an eccentric shaft gear is disposed at an end of each eccentric shaft. A means for coupling the crankshaft gears and eccentric shaft gears can be a multitude of devices, such as chains, belts, or gears. The movement of the eccentric shaft relative to the crankshaft changes the overlap between the slotted port of each piston sleeve relative to either the intake port or the exhaust port. Furthermore, at least one idling gear can be disposed on a non-drive side of the chain which can take up any extra chain slack. Furthermore, each sleeve coupler can further comprise a crankshaft aperture, wherein a corresponding crankshaft is positioned within the crankshaft aperture such that the eccentric shaft, crankshaft and cylinder are aligned within a common plane.

In yet another exemplary embodiment, an internal combustion engine includes an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts and moveable relative to the crankshafts. A pair of piston sleeves are reciprocatingly mounted in the cylinder around each piston and mounted relative to their respective eccentric shafts. Each piston sleeve can have a slotted port in communication with either the intake port or the exhaust port.

A pair of sleeve couplers are pivotably connected to their respective piston sleeves and eccentrically rotatable relative to their respective eccentric shafts. A crankshaft gear is disposed at an end of each crankshaft and an eccentric shaft gear is disposed at an end of each eccentric shaft. A means for coupling the crankshaft gears and eccentric shaft gears can be a multitude of devices, such as chains, belts, or gears.

A pair of phase couplers are helically moveable about their respective eccentric shafts. The phase couplers are also pivotably fixed and slidable relative to their respective eccentric shaft gears. Helical movement of the phase couplers about their respective eccentric shafts changes the relation of timing between the reciprocating pistons and the piston sleeves. Movement of the eccentric shaft relative to the crankshaft changes the overlap between the slotted port of each piston sleeve relative to either the intake port or the exhaust port.

Each phase coupler can include a helical slot and each eccentric shaft includes at least one protrusion disposed within each slot. Each protrusion is slidable relative to its respective slot. Each phase coupler includes a fixed or rotatably attached disk disposed perpendicular to their respective eccentric shafts.

A disk engagement can be associated with each disk and slidably fixed relative to the engine block. Each disk engagement is slidably controllable in a motion parallel to the crankshafts and eccentric shafts. The movement of each disk engagement controls the relation of timing between the reciprocating pistons and the piston sleeves. Furthermore, each eccentric shaft gear and phase couplers can include one or more elongated teeth. In an exemplary embodiment, the elongated teeth can comprise a plurality of rectangularly-shaped elongated teeth. Furthermore, the means for coupling the crankshaft gears and eccentric shaft gear can comprise a chain, a belt, or gears. Additionally, at least one idling gear may be disposed on a non-drive side of the chain or belt which can take up any extra chain or belt slack. Furthermore, each sleeve coupler can further comprise a crankshaft aperture, wherein a corresponding crankshaft is positioned within the crankshaft aperture such that the eccentric shaft, crankshaft and cylinder are aligned within a common plane.

In yet another exemplary embodiment, an internal combustion engine includes an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts and moveable relative to the crankshafts. Each crankshaft includes a crankshaft gear disposed at an end of the crankshaft. Also, each eccentric shaft includes an eccentric shaft gear disposed at an end of the eccentric shaft.

A pair of piston sleeves are reciprocatingly mounted in the cylinder around each piston and mounted relative to their respective eccentric shafts. Each piston sleeve has a slotted port in communication with either the intake port or the exhaust port. A pair of sleeve couplers are pivotably connected to their respective piston sleeves and eccentrically rotatable relative to their respective eccentric shafts.

A pair of secondary shafts are disposed perpendicular to their corresponding crankshafts and eccentric shafts. The secondary shafts comprise a pair of secondary crankshaft gears and a pair of elongators. The secondary crankshaft gears are disposed at one end of each secondary shaft where each crankshaft gear and corresponding secondary crankshaft gear are mechanically coupled. A pair of secondary eccentric shaft gears are disposed perpendicular to and coupled to their corresponding eccentric shaft gears and are also aligned with their corresponding secondary shafts.

A pair of phase couplers are helically moveable about their corresponding secondary shafts. The phase couplers are pivotably fixed and slidable relative to their respective secondary eccentric shaft gears, such that helical movement of the phase couplers about their respective secondary shafts changes the relation of timing between the reciprocating pistons and the piston sleeves and movement of each eccentric shaft relative to its respective crankshaft through the elongator changes the overlap between the slotted port of each piston sleeve relative to either the intake port or the exhaust port.

Each phase coupler can include at least one helical slot. Each secondary shaft can includes at least one protrusion disposed within each slot where each protrusion is slidable relative to its respective slot. Each phase coupler can include a fixed or rotatably attached disk disposed perpendicular to their respective secondary shafts. A disk engagement is associated with each disk and slidably fixed relative to the engine block, where each disk engagement is slidably controllable in a motion parallel to the secondary shafts. Movement of each disk engagement controls the relation of timing between the reciprocating pistons and the piston sleeves. Furthermore, each secondary eccentric shaft gear and phase couplers can include at least one elongated tooth. Furthermore, each sleeve coupler comprises a crankshaft aperture, wherein a corresponding crankshaft is positioned within the crankshaft aperture such that the eccentric shaft, crankshaft and cylinder are aligned within a common plane.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
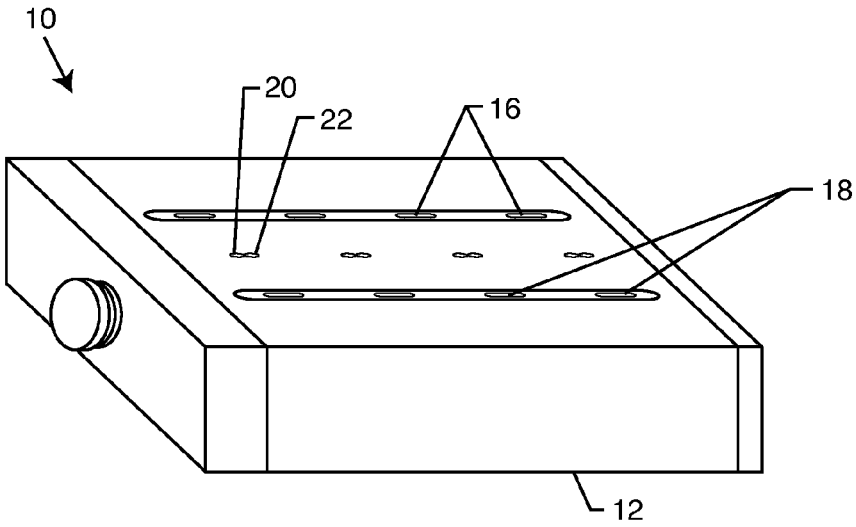
FIG. 1 is an perspective view of an exemplary internal combustion engine embodying the present invention.

As shown in the drawings for purposes of illustration, the present invention for an internal combustion engine is referred to generally by the reference number 10. A multitude of embodiments of the internal combustion engine 10 are taught herein for varying the timing between a reciprocating piston and a piston sleeve and also for changing the movement of an eccentric shaft relative to a crankshaft which then changes the overlap between a slotted port of a piston sleeve relative to either an intake port or an exhaust port. While the following detailed description describes a two-cycle, opposed piston engine 10 having one or a multitude of cylinders, the principals of this invention are applicable to two- or four-cycle engines having any number of cylinders.

Figure 2:
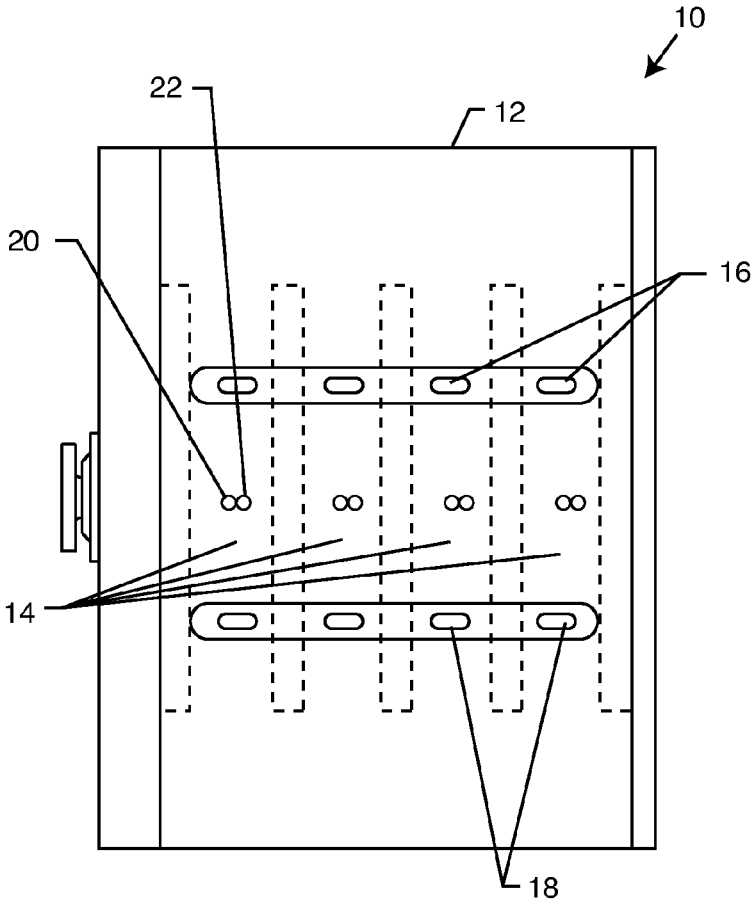
FIG. 2 is a top view of the engine of FIG. 1.

As shown in FIGS. 1 and 2, the engine 10 typically has an engine block 12 of a box shape constructed from flat plate materials or by casting a mold. The engine 10 can be designed to be horizontally positioned in a flat orientation, or vertically positioned in an upright orientation. The engine 10 is scalable in terms of how many pistons are used, and also scalable in the relative size of each piston/piston chamber.

FIG. 2 could be viewed as either the top or bottom of the engine block 12, as both sides could be similar and are mirror images of each other. In a four cylinder engine 10, the cylinder 14 has four intake ports 16 and four exhaust ports 18 in series on the top side of the engine block 12. In the center of the engine block 12, between the series of intake ports 16 and exhaust ports 18 are access points at each cylinder 14 for a fuel injector 20 and spark plug 22.

Each pair of intake 16 and exhaust ports 18 is in communication with one of the cylinders 14. The spark plug 22 and fuel injectors 20 may be configured at an angle such that the injected fuel intersects the ignition spark just inside the cylinder 14 for both the top and bottom (or side to side) of the engine block 12. In a preferred embodiment, the spark plug 22 and fuel injector 20 may be parallel and oppositely configured with the fuel injector 20 and spark plug 22 on the other side of the engine block 12. In this configuration, the fuel injected from the top of the engine block 12 would intersect with the spark from the spark plug 22 on the bottom of the engine block 12. Similarly, the fuel injected from the bottom of the engine block 12 would intersect with the spark from the spark plug 22 on the top of the engine block 12. This configuration results in better performance of the engine 10 because the combustion is more evenly distributed throughout the cylinder 14.

As shown in FIGS. 3-17, the first exemplary embodiment of the internal combustion engine 10 of the present invention includes an engine block 12 comprising a cylinder 14 including an intake port 16, and an exhaust port 18. Two linearly opposing pistons 24 are reciprocatingly mounted relative to two opposing crankshafts 26. A pair of piston sleeves 28 are reciprocatingly mounted in the cylinder 14 around each piston 24 and are connected relative to their respective crankshafts 26. Each piston sleeve 28 includes a slotted port 30 in communication with either the intake port 16 or the exhaust port 18. The slotted port 30 is formed to match (or not match) either the intake port 16 or the exhaust port 18. Many different port structures and opening designs can be practiced by one skilled in the art and this disclosure is not to be limited to the specific form shown and taught herein.

The rotation of one crankshaft 26 relative to the other crankshaft 26 can be in similar or opposite directions, depending on a specific layout and desired rotational direction. Furthermore, accessories may be driven off of either or both crankshafts 26, as is commonly practiced in current automotive engine designs.

Figure 7:
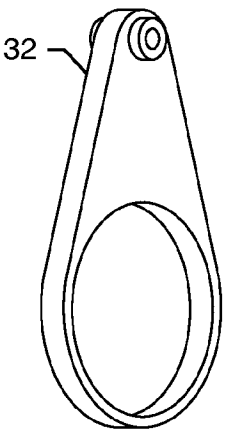
FIG. 7 is a perspective view of an exemplary sleeve coupler of the structure of FIG. 3.
Figure 8:
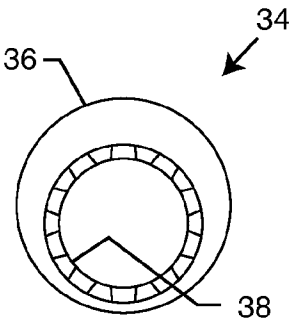
FIG. 8 is a front view of an exemplary eccentric insert of the structure of FIG. 3.
Figure 9:
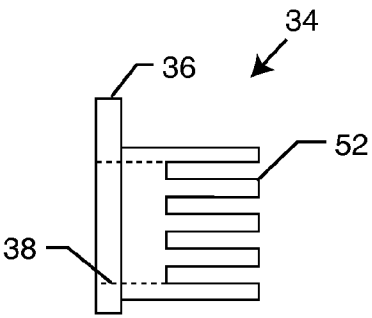
FIG. 9 is a side view of the exemplary eccentric insert of FIG. 8.
Figure 10:
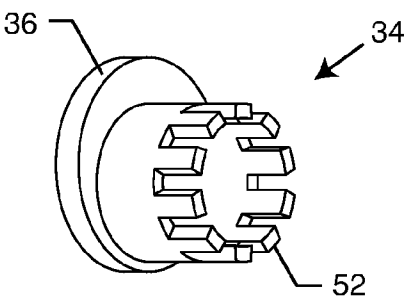
FIG. 10 is a perspective view of the exemplary eccentric insert of FIG. 8.

A pair of sleeve couplers 32 are pivotably connected to their respective piston sleeves 28 and eccentrically rotatable relative to their respective crankshafts 26. The eccentric rotation of the sleeve couplers 32 forces the piston sleeves 28 to raise and lower repeatedly such that air is either allowed or prevented from passing from the intake ports 16 and exhaust ports 18 through the slotted ports 30 in the piston sleeves 28. FIG. 7 shows an exemplary sleeve coupler 32. In essence, this structure functions similarly to the circular-shaped valves on a typical pushrod engine commonly used throughout the world today. A pair of eccentric inserts 34 each have an outside circumferential surface 36 concentrically offset from an inside circumferential surface aperture 38. An exemplary eccentric insert 34 is shown in FIGS. 8-10. It is the offset of the two surfaces 36 and 38 which then cause the sleeve couplers 32 to raise and lower. Each inside circumferential surface aperture 38 is pivotable about its respective crankshaft 26. The pivotable nature between the inside circumferential surface aperture 38 and the crankshaft 26 is what allows the timing between the pistons 24 and the piston sleeves 28 to be varied. Each outside circumferential surface 36 is also rotatable relative to its respective sleeve coupler 32.

Figure 11:
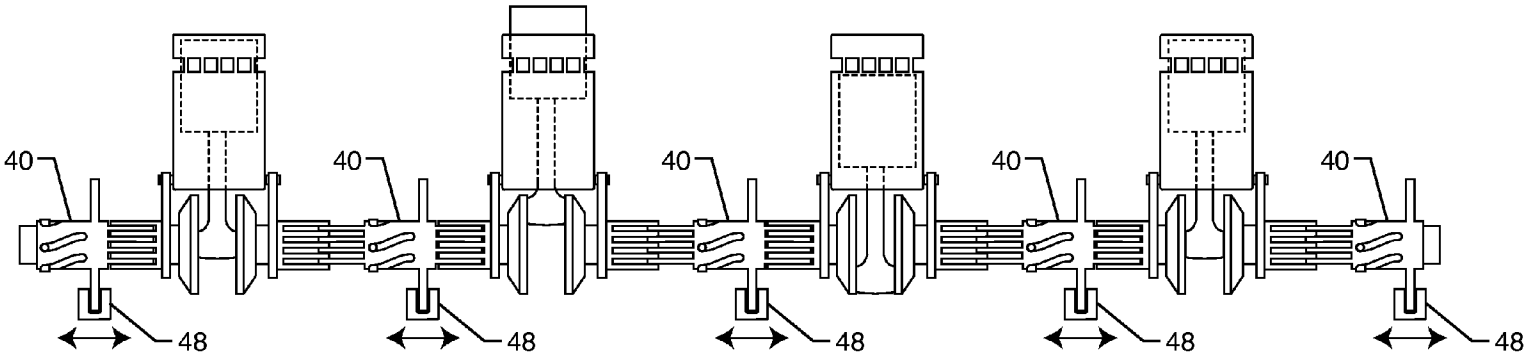
FIG. 11 is a partial side view of an embodiment of a disk engagement of the present invention.

A pair of phase couplers 40 are helically moveable about their respective crankshafts 26, as best shown in FIG. 11. The phase couplers 40 are also pivotably fixed and slidable relative to their respective eccentric inserts 34. Helical movement of the phase couplers 40 about their respective crankshafts 26 changes the relation of timing between the reciprocating pistons 24 and the piston sleeves 28. As the phase coupler 40 is moved in a helical direction, it necessarily changes its angle with respect to the crankshaft 26. As the relative angle changes, this in turn changes the angle of the eccentric insert 34 relative to the crankshaft 26.

Referring now to FIGS. 14-17, each phase coupler 40 includes a helical slot 42 and each crankshaft 26 includes at least one protrusion 44 disposed within each slot 42. The helical slot 42 is also described as a twist, or as an arcuate arch. Now referring to FIG. 6, the protrusion 44 is a raised feature that is fixed relative to the crankshaft 26. The protrusion 44 can be machined as part of the crankshaft 26, or separately added such that it is fixed in place. Each protrusion 44 is slidable relative to its respective slot 42. It is easier understood to visualize the protrusion 44 and crankshaft 26 remaining stationary while the phase coupler 40 rotates and translates in a helical motion directed by the shape of the helical slot 42.

Figure 14:
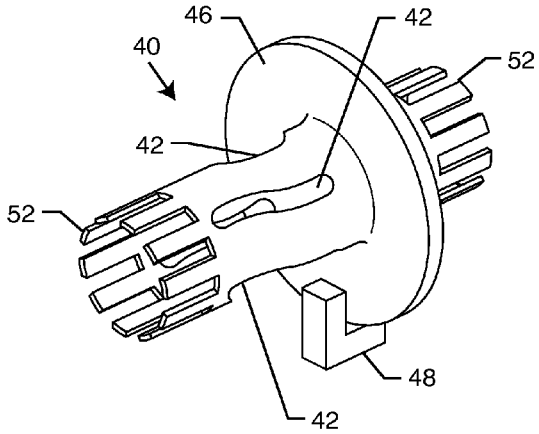
FIG. 14 is a perspective view of an exemplary phase coupler.
Figure 15:
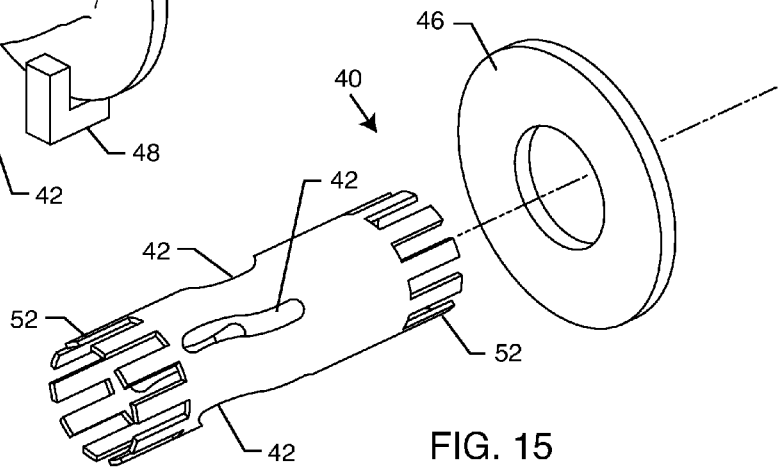
FIG. 15 is a perspective view of another exemplary phase coupler.
Figure 16:
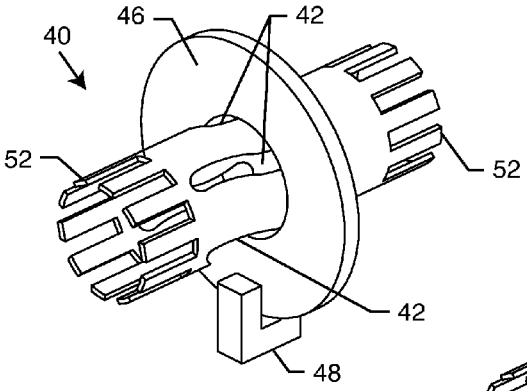
FIG. 16 is a perspective view of another exemplary phase coupler.
Figure 17:
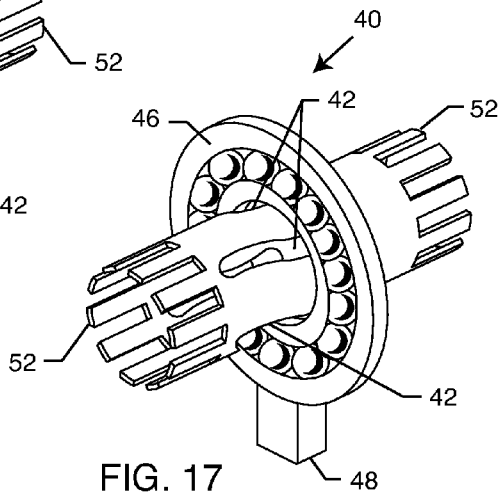
FIG. 17 is a perspective view of another exemplary phase coupler.

Each phase coupler 40 can also comprise a fixed or rotatably attached disk 46 disposed perpendicular to their respective crankshafts 26. The disk 46 can be machined with the rest of the phase coupler 40 as one single part. Alternately, the disk 46 can be rotatably attached to the phase coupler 40 through a bearing connection. FIG. 14 shows a phase coupler 40 machined from a single piece of material. FIG. 15 and FIG. 16 show how the disk 46 can be machined separate from the phase coupler 40 and later pressed or attached together. FIG. 17 is another variation of an exemplary phase coupler 40 where the disk 46 comprises a bearing connection. The bearing connection allows for a lower overall friction between the disk 46 and the disk engagement 48.

A disk engagement 48 can be associated with each disk 46 and slidably fixed relative to the engine block 12. Each disk engagement 48 is slidably controllable in a motion parallel to the crankshafts 26. The disk engagement 48 is a device that allows a translational movement to be communicated to the rotating disk 46. As the disk 46 rotates the disk engagement 48 is designed to capture the disk 46 such that the disk 46 can still rotate yet can be pushed in one direction or the other. Alternatively, if a bearing is used to rotatably attach the disk 46 to the phase coupler 40, a fixed connection can be made between each disk engagement 48 and the disk 46. Also, a common rod 50 can be fashioned to join all the disk engagements 48 such that they move in unison. As can be seen, movement of each disk engagement 48 controls the relation of timing between the reciprocating pistons 24 and the piston sleeves 28.

Figure 12:
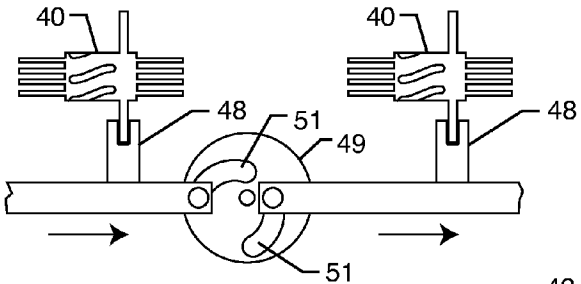
FIG. 12 is a partial side view of another embodiment of a disk engagement of the present invention.
Figure 13:
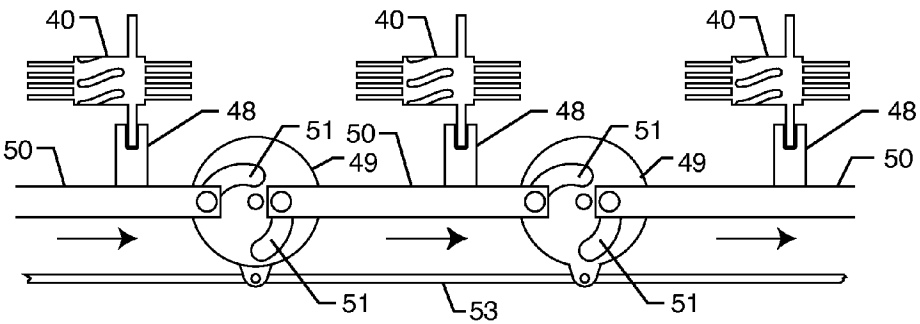
FIG. 13 is a partial side view of another embodiment of a disk engagement of the present invention.

As shown in FIGS. 12 and 13, other exemplary embodiments can be devised that control the movement of the phase couplers 40. For instance, FIG. 12 shows a circular disk 49 with slots 51, where the slots 51 reduce in radius. As the circular disk 49 rotates, it causes the rod 50 to move in a desired fashion. FIG. 13 shows yet another embodiment where the disk 49 is attached to an additional rod 53. The rod 50 and the additional rod 53 can be controlled mechanically, hydraulically, electrically, or computer controlled. The rod 50 and the rod 53 can be used with all the exemplary embodiments shown and described herein. For instance, the embodiment of FIG. 12 or 13 can be applied to control the disk engagements of FIG. 11. As can be seen by one skilled in the art a multitude of devices and techniques can control the phase couplers 40, and this disclosure is not intended to limit it to the precise form described herein.

Figure 3:
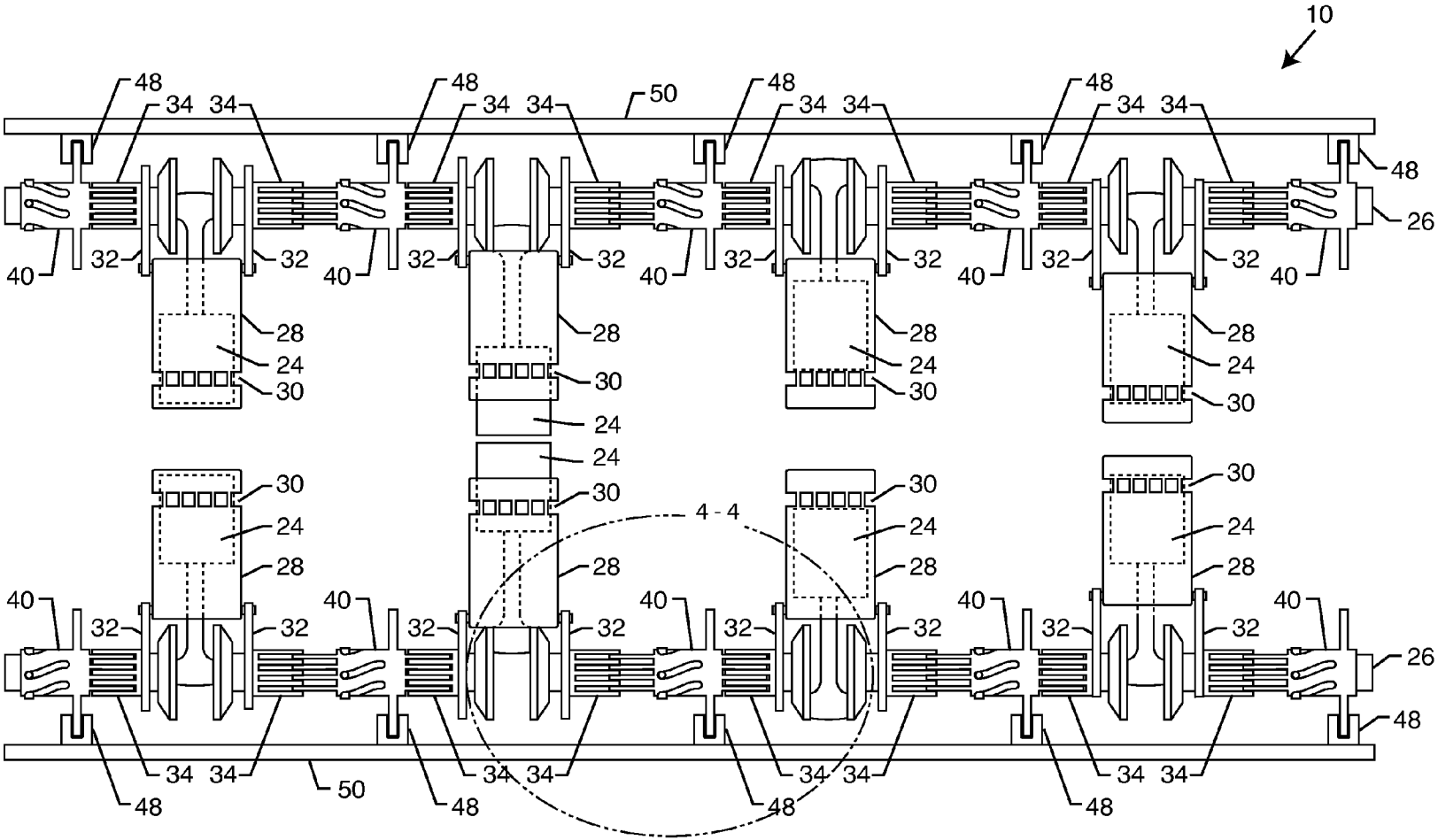
FIG. 3 side view of an exemplary embodiment of the present invention with the engine block removed to expose the internal components.
Figure 4:
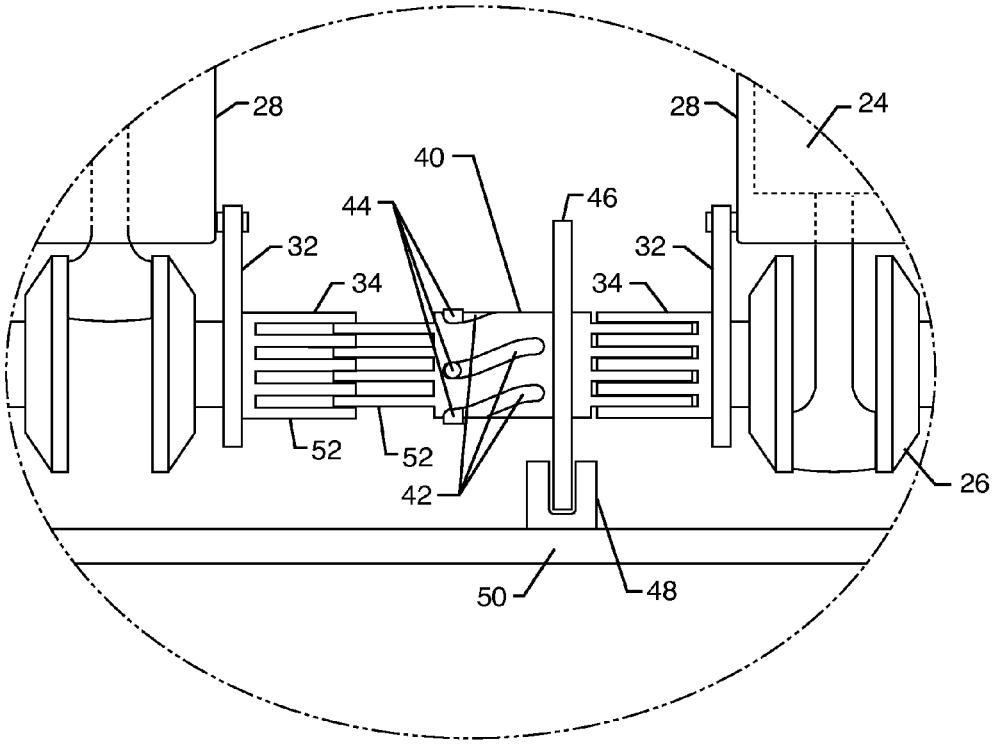
FIG. 4 an enlarged view of the structure of FIG. 3 taken along line 4-4.
Figure 5:
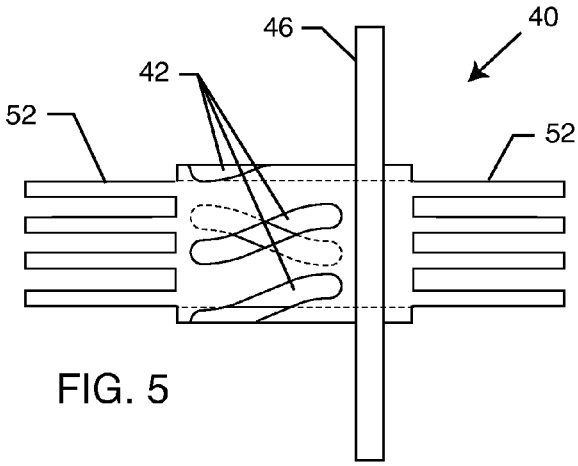
FIG. 5 is a side view of an exemplary phase coupler of the structure of FIG. 3.
Figure 6:
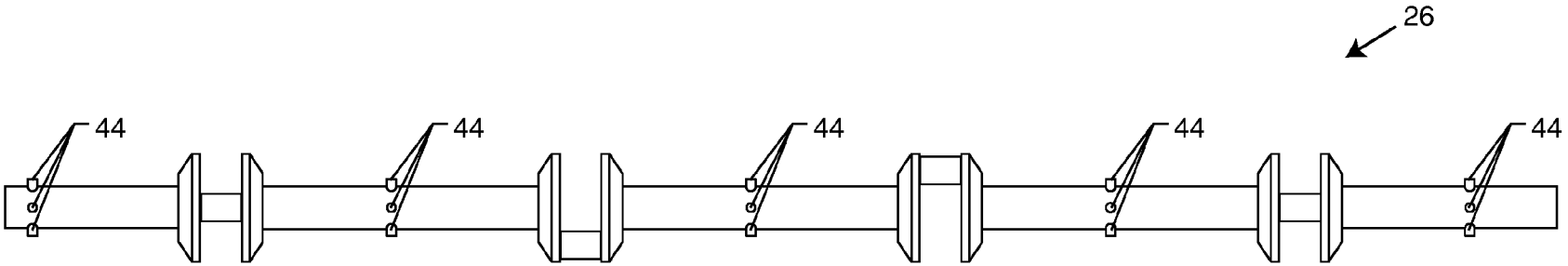
FIG. 6 is a side view of an exemplary crankshaft of the structure of FIG. 3.

As the phase coupler 40 moves in a helical motion, the distance between it and the eccentric insert 34 changes. This necessitates a slidable coupling means between the eccentric insert 34 and the phase coupler 40. One such solution is to use an elongated tooth 52 structure where rotational movement is transferred while still allowing a translation to occur. As shown in FIG. 3, the teeth 52 are engaged and are disposed on both the eccentric insert 34 and the phase coupler 40. In an exemplary embodiment, the teeth 52 are rectangularly-shaped. At least one tooth 52 one each part can be used, or alternatively a plurality of teeth 52 can be used. As can be appreciated and practiced by one skilled in the art, there are a multitude of slidable coupling means possible, and this disclosure is not to be limited to the precise form described herein.

Figure 18:
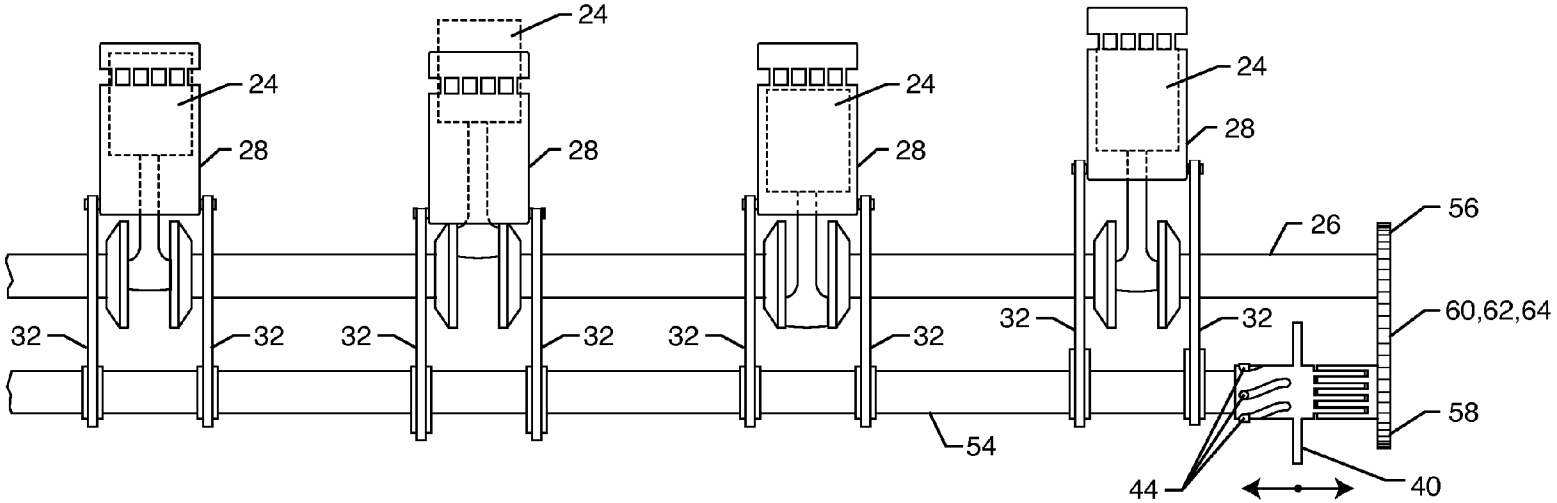
FIG. 18 is a partial side view of an exemplary embodiment of the present invention with the engine block removed to expose the internal components.
Figure 19:
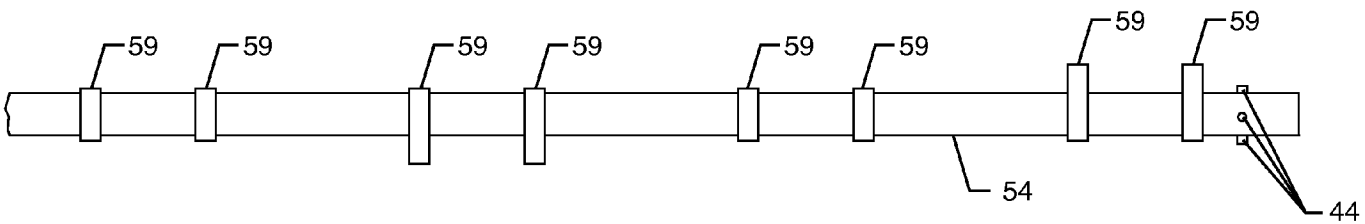
FIG. 19 is a side view of an exemplary eccentric shaft of the structure of FIG. 18.

In another exemplary embodiment of the present invention as shown in FIGS. 18-19, an internal combustion engine 10 includes an engine block 12 comprising a cylinder 14 including an intake port 16, an exhaust port 18, two linearly opposing pistons 24 reciprocatingly mounted relative to two opposing rotating crankshafts 26, and a pair of opposing rotating eccentric shafts 54 mounted parallel to the crankshafts 26. A pair of piston sleeves 28 are reciprocatingly mounted in the cylinder 14 around each piston 24 and mounted relative to their respective eccentric shafts 54. Each piston sleeve 28 can have a slotted port 30 in communication with either the intake port 16 or the exhaust port 18.

A pair of sleeve couplers 32 are pivotably connected to their respective piston sleeves 28 and eccentrically rotatable relative to their respective eccentric shafts 54. A crankshaft gear 56 is disposed at an end of each crankshaft 26 and an eccentric shaft gear 58 is disposed at an end of each eccentric shaft 54. A means for coupling the crankshaft gears 56 and eccentric shaft gears 58 can be a multitude of devices, such as chains 60, belts 62, or gears 64.

A pair of phase couplers 40 are helically moveable about their respective eccentric shafts 54. The phase couplers 40 are also pivotably fixed and slidable relative to their respective eccentric shaft gears 58. Helical movement of the phase couplers 40 about their respective eccentric shafts 54 changes the relation of timing between the reciprocating pistons 24 and the piston sleeves 28.

Each phase coupler 40 includes a helical slot 42 and each eccentric shaft 54 includes at least one protrusion 44 disposed within each slot 42. Each protrusion 44 is slidable relative to its respective slot 42. Each phase coupler 40 can include a fixed or rotatably attached disk 46 disposed perpendicular to their respective eccentric shafts 54. A disk engagement 48 can be associated with each disk 46 and slidably fixed relative to the engine block 12. Each disk engagement 48 is slidably controllable in a motion parallel to the crankshafts 26 and eccentric shafts 54. The movement of each disk engagement 48 controls the relation of timing between the reciprocating pistons 24 and the piston sleeves 28. Furthermore, each eccentric shaft gear 58 and phase couplers 40 can include at least one elongated tooth 52. Furthermore, each sleeve coupler 32 can further comprise a crankshaft aperture 66, wherein a corresponding crankshaft 26 is positioned within the crankshaft aperture 66 such that the eccentric shaft 54, crankshaft 26, and cylinder 14 are aligned within a common plane. FIG. 19 shows how the eccentric shaft 54 in this embodiment comprises the eccentrically offset circular cam 59 which causes the sleeve coupler 32 to move in a reciprocating fashion.

Figure 20:
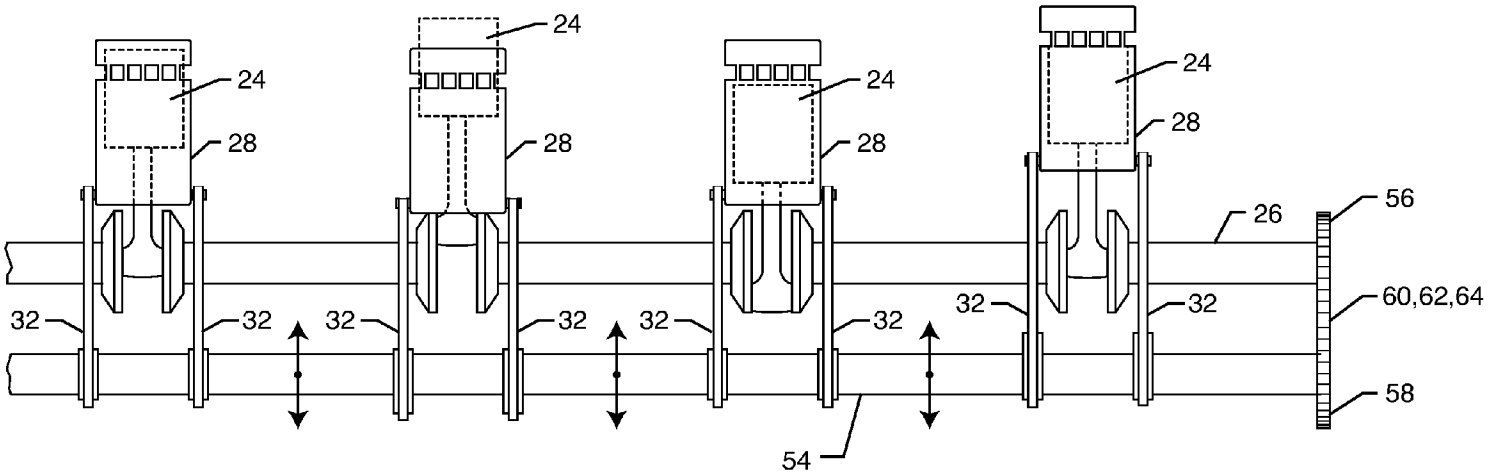
FIG. 20 is a partial side view of an exemplary embodiment of the present invention with the engine block removed to expose the internal components.
Figure 21:
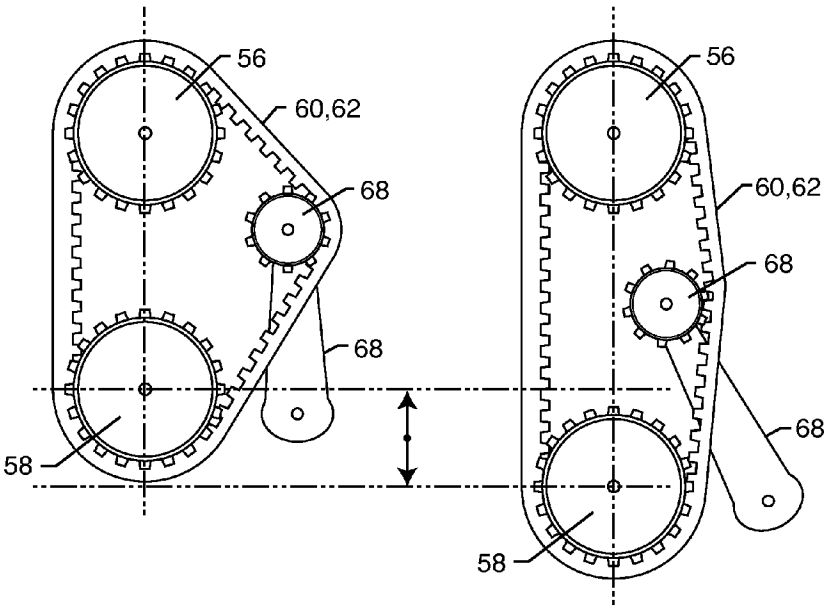
FIG. 21 is a side view of an exemplary coupling means of the structure of FIG. 20.
Figure 22:
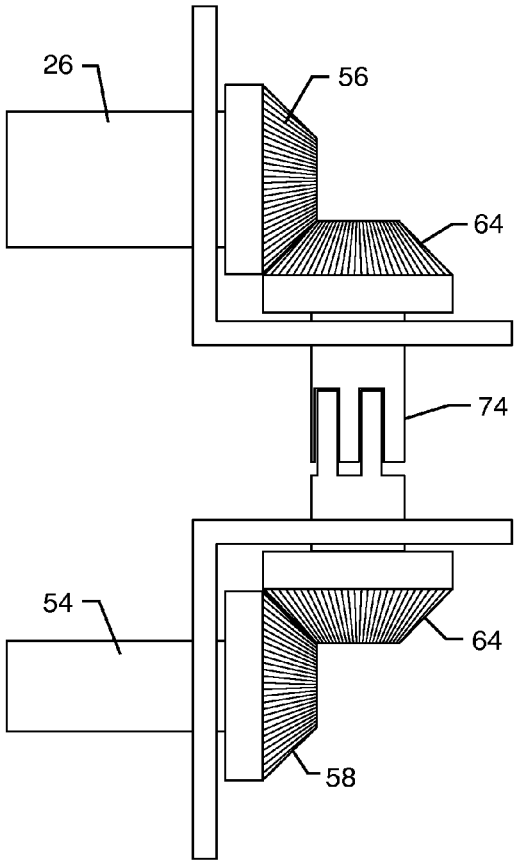
FIG. 22 is a side view of another exemplary coupling means of the structure of FIG. 20.

In yet another exemplary embodiment as shown in FIGS. 20-22, an internal combustion engine 10 includes an engine block 12 comprising a cylinder 14 including an intake port 16, an exhaust port 18, two linearly opposing pistons 24 reciprocatingly mounted relative to two opposing rotating crankshafts 26, and a pair of opposing rotating eccentric shafts 54 mounted parallel to the crankshafts 26 and moveable relative to the crankshafts 26. A pair of piston sleeves 28 are reciprocatingly mounted in the cylinder 14 around each piston 24 and mounted relative to their respective eccentric shafts 54. Each piston sleeve 28 can have a slotted port 30 in communication with either the intake port 16 or the exhaust port 18.

A pair of sleeve couplers 32 are pivotably connected to their respective piston sleeves 28 and eccentrically rotatable relative to their respective eccentric shafts 54. A crankshaft gear 56 is disposed at an end of each crankshaft 26 and an eccentric shaft gear 58 is disposed at an end of each eccentric shaft 54. A means for coupling the crankshaft gears 56 and eccentric shaft gears 58 can be a multitude of devices, such as chains 60, belts 62, or gears 64. The movement of the eccentric shaft 54 relative to the crankshaft 26 changes the overlap between the slotted port 30 of each piston sleeve relative to either the intake port 16 or the exhaust port 18.

At least one idling gear 68 can be disposed on a non-drive side of the chain 60 which can take up any extra chain slack, as shown in FIG. 21. FIG. 22 is another exemplary variation similar in functionality to FIG. 21. FIG. 22 shows how an elongator 74 can allow rotation force to be transmitted between the crankshaft 26 and the eccentric shaft 54, while allowing for a translational movement.

Figure 25:
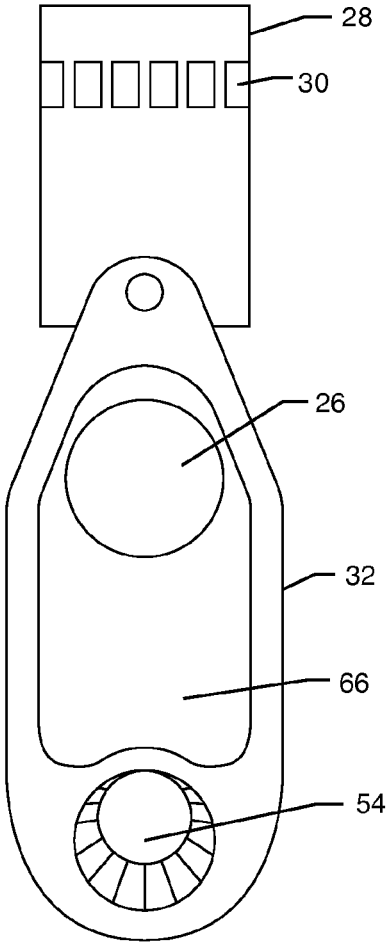
FIG. 25 is a side view of an exemplary sleeve coupler.
Figure 26:
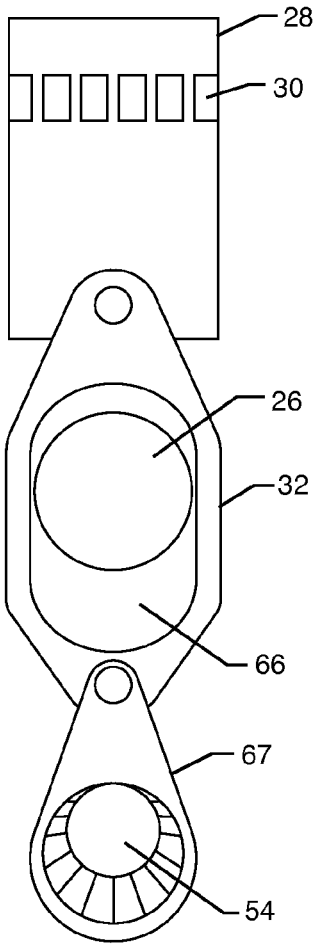
FIG. 26 is another side view of an exemplary sleeve coupler.

In any of the embodiment utilizing an eccentric shaft 54, the sleeve coupler 32 can take on many shapes and designs. For instance as shown in FIG. 25, each sleeve coupler 32 can further comprise a crankshaft aperture 66, wherein a corresponding crankshaft 26 is positioned within the crankshaft aperture 66 such that the eccentric shaft 54, crankshaft 26 and cylinder 14 are aligned within a common plane. Aligning the crankshaft 26, the eccentric shaft 54, and the piston sleeve 28 allows for better transmission of translational force. Objects are best pushed and pulled in a direct manner, however many parts may block such a design. The solution of aligning the eccentric shaft 54 with the piston sleeve 28 is to create the aperture 66. In yet another embodiment as shown in FIG. 26, the sleeve coupler 32 can be further connected to another part 67. In this embodiment the sleeve coupler 32 is constrained such that it can only slide back and forth.

Figure 23:
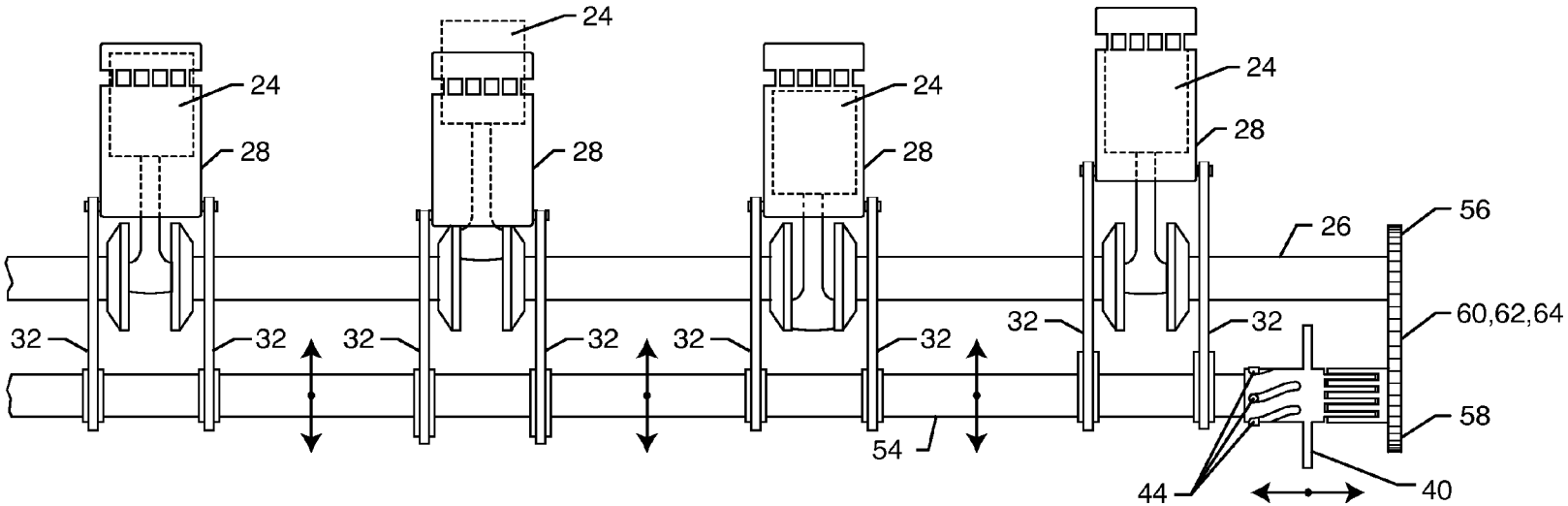
FIG. 23 is a partial side view of an exemplary embodiment of the present invention with the engine block removed to expose the internal components.

In yet another exemplary embodiment as shown in FIG. 23, an internal combustion engine 10 includes an engine block 12 comprising a cylinder 14 including an intake port 16, an exhaust port 18, two linearly opposing pistons 24 reciprocatingly mounted relative to two opposing rotating crankshafts 26, and a pair of opposing rotating eccentric shafts 54 mounted parallel to the crankshafts 26 and moveable relative to the crankshafts 26. A pair of piston sleeves 28 are reciprocatingly mounted in the cylinder 14 around each piston 24 and mounted relative to their respective eccentric shafts 54. Each piston sleeve 28 can have a slotted port 30 in communication with either the intake port 16 or the exhaust port 18.

A pair of sleeve couplers 32 are pivotably connected to their respective piston sleeves 28 and eccentrically rotatable relative to their respective eccentric shafts 54. A crankshaft gear 56 is disposed at an end of each crankshaft 26 and an eccentric shaft gear 58 is disposed at an end of each eccentric shaft 54. A means for coupling the crankshaft gears 56 and eccentric shaft gears 58 can be a multitude of devices, such as chains 60, belts 62, or gears 64.

A pair of phase couplers 40 are helically moveable about their respective eccentric shafts 54. The phase couplers 40 are also pivotably fixed and slidable relative to their respective eccentric shaft gears 58. Helical movement of the phase couplers 40 about their respective eccentric shafts 54 changes the relation of timing between the reciprocating pistons 24 and the piston sleeves 28. Movement of the eccentric shaft 54 relative to the crankshaft 26 changes the overlap between the slotted port 30 of each piston sleeve 28 relative to either the intake port 16 or the exhaust port 18.

Each phase coupler 40 can include a helical slot 42 and each eccentric shaft 54 includes at least one protrusion 44 disposed within each slot 42. Each protrusion 44 is slidable relative to its respective slot 42. Each phase coupler 40 includes a fixed or rotatably attached disk 46 disposed perpendicular to their respective eccentric shafts 54.

A disk engagement 48 can be associated with each disk 46 and slidably fixed relative to the engine block 12. Each disk engagement 48 is slidably controllable in a motion parallel to the crankshafts 26 and eccentric shafts 54. The movement of each disk engagement 48 controls the relation of timing between the reciprocating pistons 24 and the piston sleeves 28. Furthermore, each eccentric shaft gear 58 and phase coupler 40 can include a plurality of elongated teeth 52. Furthermore, the means for coupling the crankshaft gears 56 and eccentric shaft gear 58 can comprise a chain 60, a belt 62, or gears 64. Additionally, at least one idling gear 68 may be disposed on a non-drive side of the chain 60 which can take up any extra chain slack. Furthermore, each sleeve coupler 32 can further comprise a crankshaft aperture 66, wherein a corresponding crankshaft 26 is positioned within the crankshaft aperture 66 such that the eccentric shaft 54, crankshaft 26 and cylinder 14 are aligned within a common plane.

Figure 24:
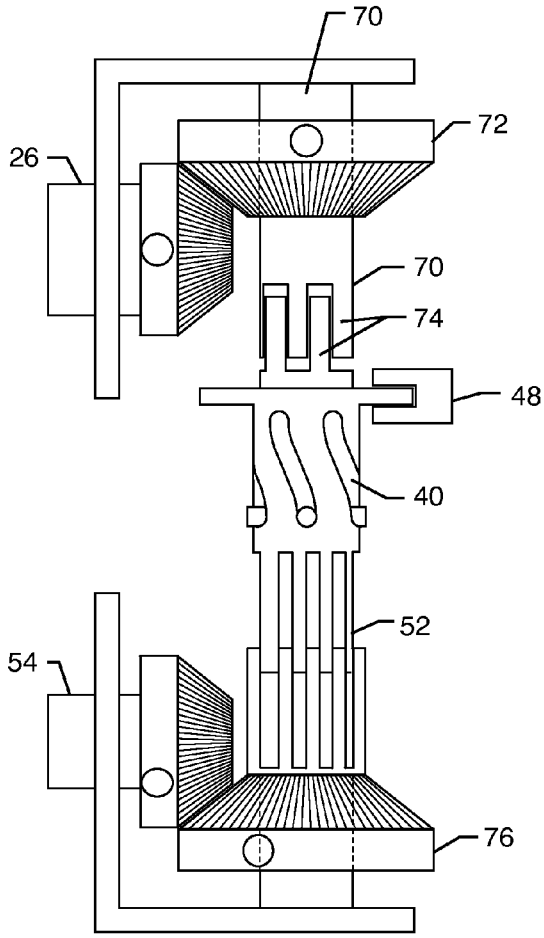
FIG. 24 is a partial side view of an exemplary embodiment of the present invention with the engine block removed to expose the internal components.

In yet another exemplary embodiment shown in FIG. 24, an internal combustion engine 10 includes an engine block 12 comprising a cylinder 14 including an intake port 16, an exhaust port 18, two linearly opposing pistons 24 reciprocatingly mounted relative to two opposing rotating crankshafts 26, and a pair of opposing rotating eccentric shafts 54 mounted parallel to the crankshafts 26 and moveable relative to the crankshafts 26. Each crankshaft 26 includes a crankshaft gear 56 disposed at an end of the crankshaft 26. Also, each eccentric shaft 54 includes an eccentric shaft gear 58 disposed at an end of the eccentric shaft 54.

A pair of piston sleeves 28 are reciprocatingly mounted in the cylinder 14 around each piston 24 and mounted relative to their respective eccentric shafts 54. Each piston sleeve 28 has a slotted port 30 in communication with either the intake port 16 or the exhaust port 18. A pair of sleeve couplers 32 are pivotably connected to their respective piston sleeves 28 and eccentrically rotatable relative to their respective eccentric shafts 54.

A pair of secondary shafts 70 are disposed perpendicular to their corresponding crankshafts 26 and eccentric shafts 54. The secondary shafts 70 comprise a pair of secondary crankshaft gears 72 and a pair of elongators 74. The secondary crankshaft gears 72 are disposed at one end of each secondary shaft 70 where each crankshaft gear 56 and corresponding secondary crankshaft gear 72 are mechanically coupled. A pair of secondary eccentric shaft gears 76 are disposed perpendicular to and coupled to their corresponding eccentric shaft gears 58 and are also aligned with their corresponding secondary shafts70.

A pair of phase couplers 40 are helically moveable about their corresponding secondary shafts 70. The phase couplers 40 are pivotably fixed and slidable relative to their respective secondary eccentric shaft gears 76, such that helical movement of the phase couplers 40 about their respective secondary shafts 70 changes the relation of timing between the reciprocating pistons 24 and the piston sleeves 28 and movement of each eccentric shaft 54 relative to its respective crankshaft 26 through the elongator 74 changes the overlap between the slotted port 30 of each piston sleeve 28 relative to either the intake port 16 or the exhaust port 18.

Each phase coupler 40 can include at least one helical slot 42. Each secondary shaft 70 can include at least one protrusion 44 disposed within each slot 42 where each protrusion 44 is slidable relative to its respective slot 42. Each phase coupler 40 can include a fixed or rotatably attached disk 46 disposed perpendicular to their respective secondary shafts 70. A disk engagement 48 is associated with each disk 46 and slidably fixed relative to the engine block 12, where each disk engagement 48 is slidably controllable in a motion parallel to the secondary shafts 70. Movement of each disk engagement 48 controls the relation of timing between the reciprocating pistons 24 and the piston sleeves 28. Furthermore, each secondary eccentric shaft gear 76 and phase couplers 40 can include at least one elongated tooth 52. Furthermore, each sleeve coupler 32 comprises a crankshaft aperture 66, wherein a corresponding crankshaft 26 is positioned within the crankshaft aperture 66 such that the eccentric shaft 56, crankshaft 26 and cylinder 14 are aligned within a common plane.

Figure 27:
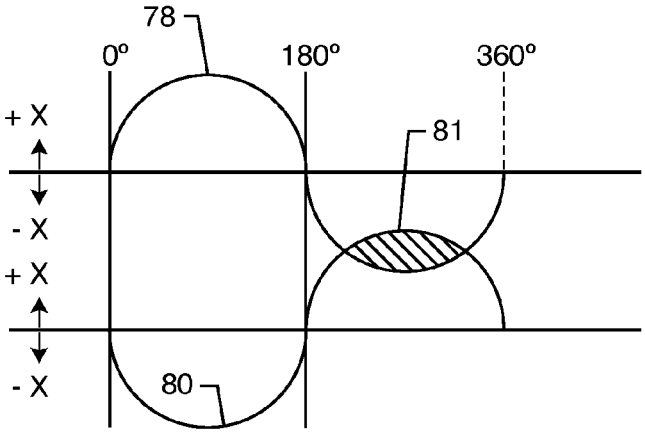
FIG. 27 is a baseline graph of the piston movement and piston sleeve movement.

FIG. 27 is a baseline graph of the piston movement 78 compared with the piston sleeve movement 80; A full 360 degrees of rotation of the crankshaft 26 is plotted showing both the piston 24 and the piston sleeve 28 in their respective positions along the x-axis. The cross-sectioned area 81 represents the overlap between the slotted port 30 and either the intake port 16 or the exhaust port 18.

Figure 28:
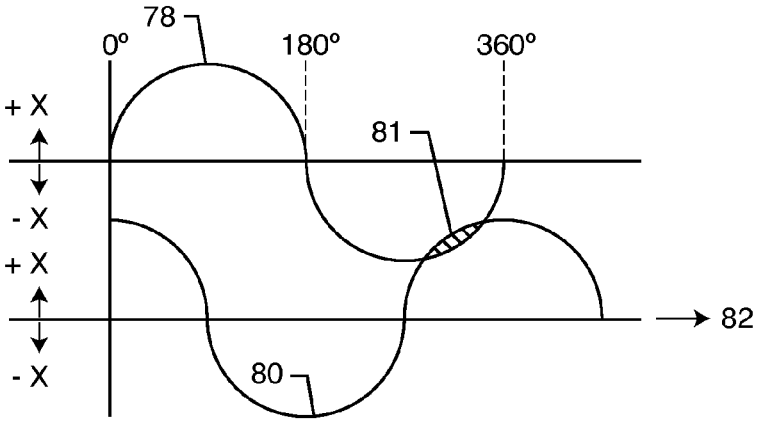
FIG. 28 is a graph similar to FIG. 27 now showing a phase shift of the piston relative to the piston sleeve.

FIG. 28 is a graph similar to FIG. 27 now showing a phase shift 82 of the piston sleeve movement 80. The piston sleeve movement 80 has been shifted to the right and the overlap area 81 has decreased as compared to FIG. 27. Changing the phase shift 82 between the piston 24 and the piston sleeves 28 is accomplished through the various embodiments utilizing a phase coupler 40.

Figure 29:
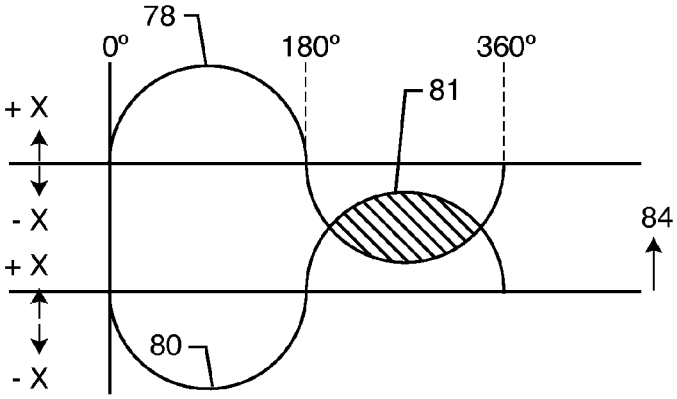
FIG. 29 is a graph similar to FIG. 27 now showing a change of overlap between the slotted port of each piston sleeve relative to either the intake port or the exhaust port.

FIG. 29 is a graph similar to FIG. 27 now showing a change of overlap between the slotted port 30 of each piston sleeve 28 relative to either the intake port 16 or the exhaust port 18. An overlap shift 84 occurs in the embodiments where the eccentric shaft 54 moves closer or further away from the crankshaft 26. Accordingly, the area 81 has increased as the eccentric shaft 54 moved closer to the crankshaft 26.

Figure 30:
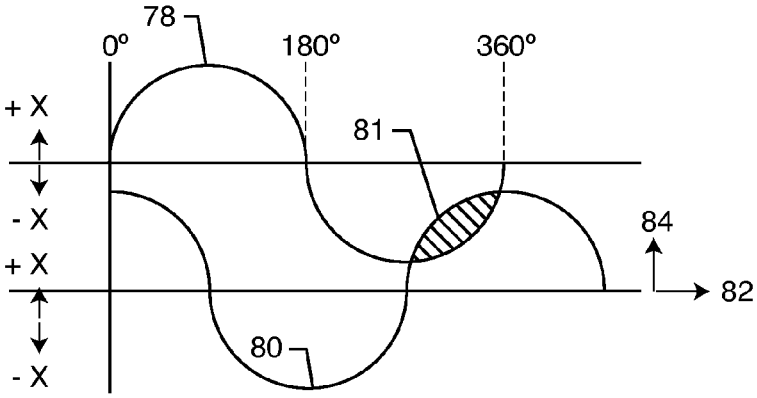
FIG. 30 is a graph similar to FIG. 27 now showing a phase shift of the piston relative to the piston sleeve and also the change of overlap between the slotted port of each piston sleeve to either the intake port or exhaust port.

FIG. 30 is a graph similar to FIG. 27 now combining the results of a phase shift 82 and an overlap shift 84. This embodiment of the present invention now shows a phase shift 82 of the piston 24 relative to the piston sleeve 28 and also the change of overlap between the slotted port 30 of each piston sleeve 28 to either the intake port 16 or exhaust port 18. Accordingly, the area 81 has been modified from the baseline shown in FIG. 27.

Figure 31:
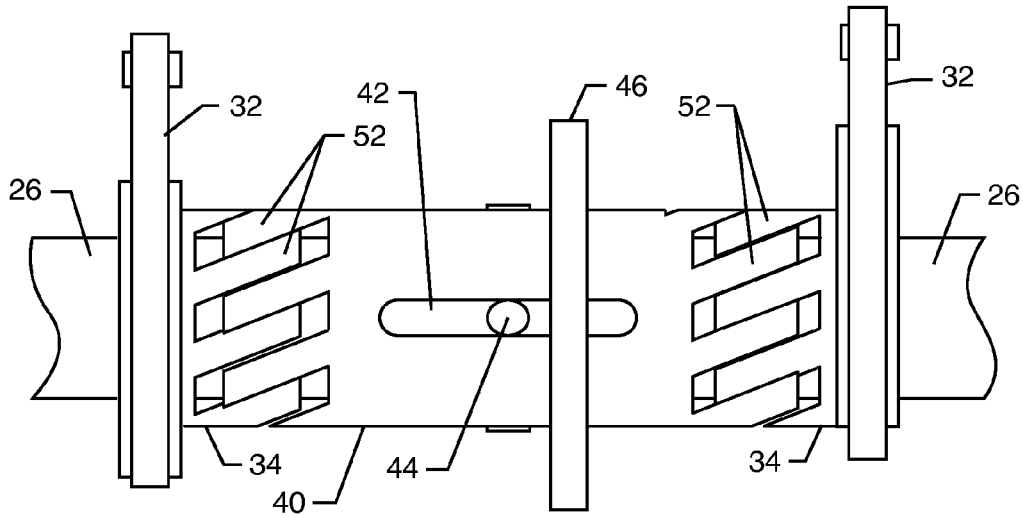
FIG. 31 is side view of another exemplary embodiment of a phase coupler.

FIG. 31 is another exemplary embodiment of a phase coupler 40. Rather than using a helical slot as in the previous embodiments, the slot 42 is now linear/straight where the protrusion 44 of the crankshaft 26 slides in a straight motion relative to the phase coupler 40. However, the elongated teeth 52 on the phase coupler 40 and the eccentric inserts 34 are now cut at angle. As the disk 46 is moved either to the left or the right, it forces the rotation between the phase coupler 40 and the eccentric inserts 34 to change. This configuration still allows the phase shift 82 to be controllable. It is to be understood by one skilled in the art that this embodiment of the phase coupler 40 and eccentric insert 34 can be used on any of the previously described embodiments.

Figure 32:
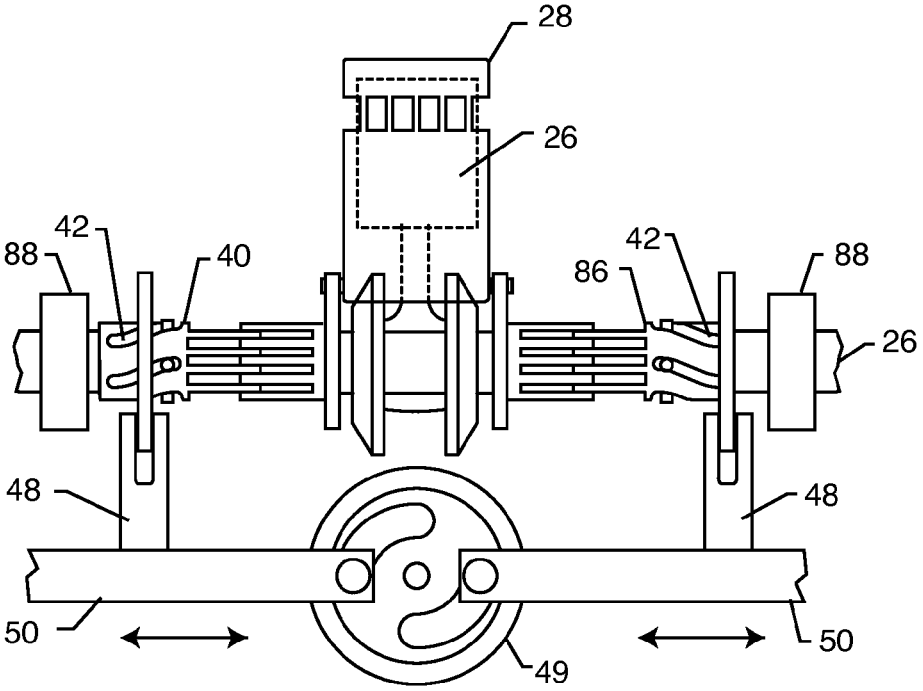
FIG. 32 is side view of an exemplary embodiment of a reverse phase coupler.

FIG. 32 is a side view of another exemplary embodiment of a phase coupler 40 and a reverse phase coupler 86. FIG. 32 shows how a single piston 24 can have two phase couplers on each side, such that one is phase coupler 40 as previously shown and described and the other is a reverse phase coupler 86 where the helical slots 42 are oppositely disposed. The helical slots 42 are oppositely disposed such that both the phase coupler 40 and reverse phase coupler 86 work together to control the piston sleeve 28. A multitude of bearings 88 can then provide additional support for the crankshaft 26. It can be seen by one skilled in the art that this embodiment may be applied to any of the previously disclosed exemplary embodiments.

Figure 33:
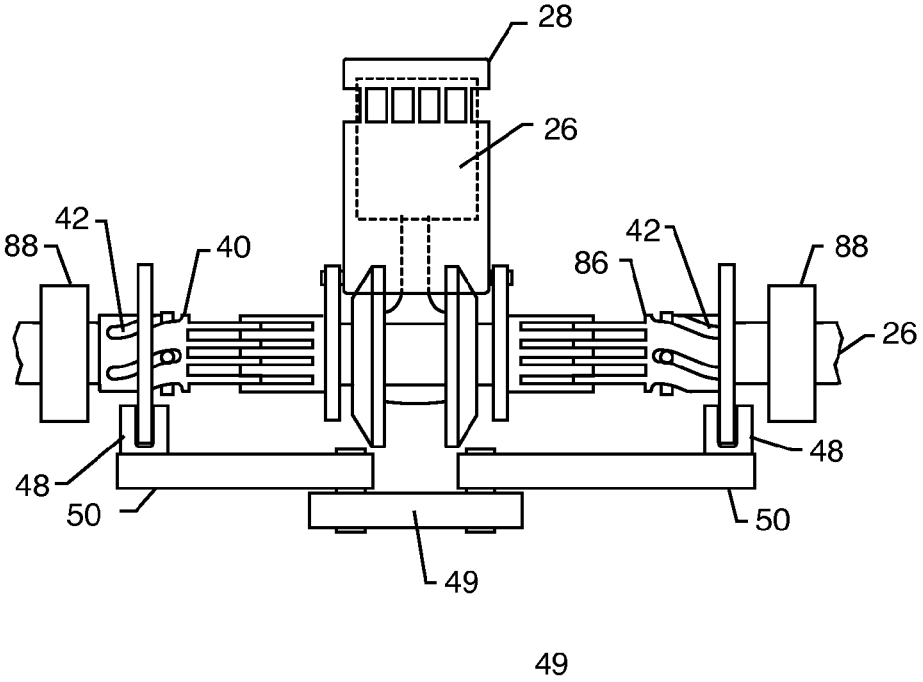
FIG. 33 is side view of another exemplary embodiment of a reverse phase coupler.

FIG. 33 is a side view of another exemplary embodiment of a reverse phase coupler 86 similar to FIG. 32. Compared to FIG. 32, the circular disk 49 has been rotated 90 degrees. As can be seen, the exact position of the disk 49 can vary significantly with respect to the crankshaft 26. It can be seen by one skilled in the art that this embodiment may be applied to any of the previously disclosed exemplary embodiments.

Although several embodiments have been described in detail for purposes of illustration, various modifications may be made to each without departing from the scope and spirit of the invention. Accordingly, the invention is not to be limited, except as by the appended claims.

What is claimed is:

1. An internal combustion engine having reciprocating piston sleeves, comprising:

an engine block comprising a cylinder including an intake port, an exhaust port, and two linearly opposing pistons reciprocatingly mounted relative to two opposing crankshafts;

a pair of piston sleeves reciprocatingly mounted in the cylinder around each piston and connected relative to their respective crankshafts, each piston sleeve having a slotted port in communication with either the intake port or the exhaust port;

a pair of sleeve couplers pivotably connected to their respective piston sleeves and eccentrically rotatable relative to their respective crankshafts;

a pair of eccentric inserts each having an outside circumferential surface concentrically offset from an inside circumferential surface aperture, where each inside circumferential surface aperture is pivotable about its respective crankshaft and each outside circumferential surface is rotatable relative to its respective sleeve coupler; and a pair of phase couplers helically moveable about their respective crankshafts, where the phase couplers are pivotably fixed and slidable relative to their respective eccentric inserts, such that helical movement of the phase couplers about their respective crankshafts changes the relation of timing between the reciprocating pistons and the piston sleeves;

wherein each phase coupler includes a helical or linear slot, each crankshaft includes at least one protrusion disposed within each slot, and each protrusion is slidable relative to its respective slot.

2. The engine of claim 1, wherein each phase coupler includes a disk disposed perpendicular to their respective crankshafts.

3. The engine of claim 2, wherein the disk is fixed relative to the phase coupler.

4. The engine of claim 2, wherein the disk is rotatably attached relative to the phase coupler.

5. The engine of claim 2, including a disk engagement associated with each disk and slidably fixed relative to the engine block, where each disk engagement is slidably controllable in a motion parallel to the crankshafts.

6. The engine of claim 5, where movement of each disk engagement controls the relation of timing between the reciprocating pistons and the piston sleeves.

7. The engine of claim 6, where each eccentric insert and phase coupler includes at least one elongated tooth.

8. An internal combustion engine having an adjustable and reciprocating piston sleeves, comprising:

an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts;

a pair of piston sleeves reciprocatingly mounted in the cylinder around each piston and mounted relative to their respective eccentric shafts, each piston sleeve having a slotted port in communication with either the intake port or the exhaust port;

a pair of sleeve couplers pivotably connected to their respective piston sleeves and eccentrically rotatable relative to their respective eccentric shafts;

a crankshaft gear disposed at an end of each crankshaft;

an eccentric shaft gear disposed at an end of each eccentric shaft;

a means for coupling the crankshaft gears and eccentric shaft gears; and a pair of phase couplers helically moveable about their respective eccentric shafts, where the phase couplers are pivotably fixed and slidable relative to their respective eccentric shaft gears, such that helical movement of the phase couplers about their respective eccentric shafts changes the relation of timing between the reciprocating pistons and the piston sleeves;

wherein each phase coupler includes a helical or linear slot, each eccentric shaft includes at least one protrusion disposed within each slot, and each protrusion is slidable relative to its respective slot.

9. The engine of claim 8, wherein each phase coupler includes a disk disposed perpendicular to their respective eccentric shafts.

10. The engine of claim 9, wherein the disk is fixed relative to the phase coupler.

11. The engine of claim 9, wherein the disk is rotatably attached relative to the phase coupler.

12. The engine of claim 9, including a disk engagement associated with each disk and slidably fixed relative to the engine block, where each disk engagement is slidably controllable in a motion parallel to the crankshafts and eccentric shafts.

13. The engine of claim 12, where movement of each disk engagement controls the relation of timing between the reciprocating pistons and the piston sleeves.

14. The engine of claim 13, where each eccentric shaft gear and phase coupler includes at least one elongated tooth.

15. The engine of claim 14, wherein each sleeve coupler comprises a crankshaft aperture, wherein a corresponding crankshaft is positioned within the crankshaft aperture such that the eccentric shaft, crankshaft and cylinder are aligned within a common plane.

16. An internal combustion engine having an adjustable and reciprocating piston sleeves, comprising:

an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts and moveable relative to the crankshafts;

a pair of piston sleeves reciprocatingly mounted in the cylinder around each piston and mounted relative to their respective eccentric shafts, each piston sleeve having a slotted port in communication with either the intake port or the exhaust port;

a pair of sleeve couplers pivotably connected to their respective piston sleeves and eccentrically rotatable relative to their respective eccentric shafts;

a crankshaft gear disposed at an end of each crankshaft;

an eccentric shaft gear disposed at an end of each eccentric shaft;

a means for coupling the crankshaft gears and eccentric shaft gears; and a pair of phase couplers helically moveable about their respective eccentric shafts, where the phase couplers are pivotably fixed and slidable relative to their respective eccentric shaft gears, such that helical movement of the phase couplers about their respective eccentric shafts changes the relation of timing between the reciprocating pistons and the piston sleeves and movement of the eccentric shaft relative to the crankshaft changes the overlap between the slotted port of each piston sleeve relative to either the intake port or the exhaust port;

wherein each phase coupler includes a helical or linear slot, and wherein each eccentric shaft includes at least one protrusion disposed within each slot.

17. The engine of claim 16, wherein each phase coupler includes a disk disposed perpendicular to their respective eccentric shafts.

18. An internal combustion engine having an adjustable and reciprocating piston sleeves, comprising:

an engine block comprising a cylinder including an intake port, an exhaust port, two linear opposing pistons reciprocatingly mounted relative to two opposing rotating crankshafts, and a pair of opposing rotating eccentric shafts mounted parallel to the crankshafts and moveable relative to the crankshafts;

a pair of piston sleeves reciprocatingly mounted in the cylinder around each piston and mounted relative to their respective eccentric shafts, each piston sleeve having a slotted port in communication with either the intake port or the exhaust port;

a pair of sleeve couplers pivotably connected to their respective piston sleeves and eccentrically rotatable relative to their respective eccentric shafts;

a means for coupling the crankshaft gears and eccentric shaft gears; and a pair of phase couplers helically moveable about their respective eccentric shafts, where the phase couplers are pivotably fixed and slidable relative to their respective eccentric shaft gears, such that helical movement of the phase couplers about their respective eccentric shafts changes the relation of timing between the reciprocating pistons and the piston sleeves and movement of the eccentric shaft relative to the crankshaft changes the overlap between the slotted port of each piston sleeve relative to either the intake port or the exhaust port;

wherein each phase coupler includes a helical or linear slot;

wherein each protrusion is slidable relative to its respective slot.

19. The engine of claim 18, wherein the disk is fixed relative to the phase coupler.

20. The engine of claim 18, wherein the disk is rotatably attached relative to the phase coupler.

21. The engine of claim 18, including a disk engagement associated with each disk and slidably fixed relative to the engine block, where each disk engagement is slidably controllable in a motion parallel to the crankshafts and eccentric shafts.

22. The engine of claim 21, wherein movement of each disk engagement controls the relation of timing between the reciprocating pistons and the piston sleeves.

23. The engine of claim 22, wherein each eccentric shaft gear and phase couplers includes at least one elongated tooth.

24. The engine of claim 23, wherein the means for coupling the crankshaft gears and eccentric shaft gear comprises a chain, a belt, or gears.

25. The engine of claim 24, further including at least one idling gear on a non-drive side of the chain or belt.

26. The engine of claim 25, wherein each sleeve coupler comprises a crankshaft aperture, wherein a corresponding crankshaft is positioned within the crankshaft aperture such that the eccentric shaft, crankshaft and cylinder are aligned within a common plane.

27. An internal combustion engine having adjustable and reciprocating piston sleeves, comprising:

an engine block comprising a cylinder including an intake port, an exhaust port, two linearly opposing pistons reciprocatingly mounted relative to two opposing rotating crankshafts, and a pair of opposing rotating eccentric shafts mounted parallel to the crankshafts and moveable relative to the crankshafts, where each crankshaft includes a crankshaft gear disposed at an end of the crankshaft and each eccentric shaft includes an eccentric shaft gear disposed at an end of the eccentric shaft;

a pair of piston sleeves reciprocatingly mounted in the cylinder around each piston and mounted relative to their respective eccentric shafts, each piston sleeve having a slotted port in communication with either the intake port or the exhaust port;

a pair of sleeve couplers pivotably connected to their respective piston sleeves and eccentrically rotatable relative to their respective eccentric shafts;

a pair of secondary shafts disposed perpendicular to their corresponding crankshafts and eccentric shafts comprising a pair of secondary crankshaft gears and a pair of elongators, where the secondary crankshaft gears are disposed at one end of each secondary shaft where each crankshaft gear and corresponding secondary crankshaft gear are mechanically coupled;

a pair of secondary eccentric shaft gears disposed perpendicular and coupled to their corresponding eccentric shaft gears and aligned with their corresponding secondary shafts; and a pair of phase couplers helically moveable about their corresponding secondary shafts, where the phase couplers are pivotably fixed and slidable relative to their respective secondary eccentric shaft gears, such that helical movement of the phase couplers about their respective secondary shafts changes the relation of timing between the reciprocating pistons and the piston sleeves and movement of each eccentric shaft relative to its respective crankshaft through the elongator changes the overlap between the slotted port of each piston sleeve relative to either the intake port or the exhaust port.

28. The engine of claim 27, wherein each phase coupler includes at least one helical slot.

29. The engine of claim 28, wherein each secondary shaft includes at least one protrusion disposed within each slot.

30. The engine of claim 29, wherein each protrusion is slidable relative to its respective slot.

31. The engine of claim 30, wherein each phase coupler includes a disk disposed perpendicular to their respective secondary shafts.

32. The engine of claim 31, wherein the disk is fixed relative to the phase coupler.

33. The engine of claim 31, wherein the disk is rotatably attached relative to the phase coupler.

34. The engine of claim 31, including a disk engagement associated with each disk and slidably fixed relative to the engine block, where each disk engagement is slidably controllable in a motion parallel to the secondary shafts.

35. The engine of claim 34, wherein movement of each disk engagement controls the relation of timing between the reciprocating pistons and the piston sleeves.

36. The engine of claim 35, wherein each secondary eccentric shaft gear and phase couplers includes at least one elongated tooth.

37. The engine of claim 36, wherein each sleeve coupler comprises a crankshaft aperture, wherein a corresponding crankshaft is positioned within the crankshaft aperture such that the eccentric shaft, crankshaft and cylinder are aligned within a common plane.

* * * * *